US008863823B1

(12) United States Patent
Nikouline

(10) Patent No.: US 8,863,823 B1
(45) Date of Patent: Oct. 21, 2014

(54) UNIVERSAL UNDERGROUND HYDRO-SLOTTING PERFORATION SYSTEM CONTROLLED BY WORKING FLUID PRESSURE FOR ACTIVATION AND INTENSIFICATION OF GAS, OIL, AND HYDRO-GEOLOGICAL WELLS

(71) Applicant: Anatoli Nikouline, Ontario (CA)

(72) Inventor: Anatoli Nikouline, Ontario (CA)

( * ) Notice: Subject to any disclaimer, the term of this patent is extended or adjusted under 35 U.S.C. 154(b) by 0 days.

(21) Appl. No.: 14/088,604

(22) Filed: Nov. 25, 2013

(51) Int. Cl.
*E21B 43/114* (2006.01)

(52) U.S. Cl.
CPC ..... *E21B 43/114* (2013.01)
USPC ..... 166/55.2; 166/298

(58) Field of Classification Search
USPC ..... 166/55.2, 55.6, 55.7, 55.8, 376, 298; 83/177; 175/424
See application file for complete search history.

(56) References Cited

U.S. PATENT DOCUMENTS

| | | | | |
|---|---|---|---|---|
| RE21,085 | E * | 5/1939 | O'Neill | 166/298 |
| 3,130,786 | A * | 4/1964 | Brown et al. | 175/424 |
| 4,227,582 | A * | 10/1980 | Price | 175/16 |
| 5,337,825 | A * | 8/1994 | Marmorstein et al. | 166/307 |
| 6,651,741 | B2 * | 11/2003 | Bassin et al. | 166/268 |
| 7,073,587 | B2 * | 7/2006 | Bassin et al. | 166/298 |
| 7,140,429 | B2 * | 11/2006 | Grebennikov et al. | 166/55 |
| 8,240,369 | B1 * | 8/2012 | Nikouline et al. | 166/55.2 |
| 2006/0086504 | A1 * | 4/2006 | Veselkov | 166/298 |
| 2007/0187086 | A1 * | 8/2007 | Ivanov et al. | 166/55.2 |
| 2009/0101414 | A1 * | 4/2009 | Brunet et al. | 175/62 |

* cited by examiner

*Primary Examiner* — Daniel P Stephenson
(74) *Attorney, Agent, or Firm* — Henry M Feiereisen, LL

(57) ABSTRACT

An underground hydro-slotting perforation system includes an adaptor connectable to a tubing, a tail part connected to the adaptor, a hydraulic block connected to the tail part, a return block connected with the hydraulic block, and a perforator connected with the return block and providing a hydro-slotting.

4 Claims, 19 Drawing Sheets

UNIVERSAL UNDERGROUND HYDRO-SLOTTING PERFORATION SYSTEM CONTROLLED BY WORKING FLUID PRESSURE FOR ACTIVATION AND INTENSIFICATION OF GAS, OIL, AND HYDRO-GEOLOGICAL WELLS

BACKGROUND OF THE INVENTION

The present invention relates to equipment for underground hydro-slotting perforation, controlled by a working fluid pressure for activation and intensification of gas, oil and hydro-geological wells by a slot discharge method.

Equipment of this type is used for activation and intensification of industrial inflows of a useful product in oil, gas and hydro-geological wells, which are newly drilled or used before, both vertical and horizontal. The basis for operation of this equipment is slot unloading of productive formations and removal of stresses generated during drilling of wells in a near-well zone. The hydro-slotting perforation equipment provides ecologically safe methods of product inflow intensification. Water and abrasive sand are used during its operation.

It is believed that the existing underground hydro-slotting equipment can be further improved to simplify its construction, to improve its reliability, and to increase its efficiency of operation.

SUMMARY OF THE INVENTION

Accordingly, it is an object of the present invention to provide a universal underground hydro-slotting perforation system, which is a further improvement of existing hydro-slotting systems.

In keeping with these objects and with others which will become apparent hereinafter, one feature of the present invention resides, briefly stated in an underground hydro-slotting perforation system, which has an adaptor connectable to a tubing, a tail part connected to said adaptor, a hydraulic block connected with said tail part, a return block connected with said hydraulic block, and a perforator connected with said return block and providing a hydro-slotting.

When the system is designed in accordance with the present invention, the tail part is a component which is separate from the adapter and thereby these two components can be manufactured easier is one casing, which results in a significant simplification of the manufacturing process.

In accordance with another feature of the present invention, said adaptor has a seat with which a ball that closes said seat for testing the tubing cooperates, and wherein said seat is formed by two openings which have different diameters and follow each other in an axial direction.

This provides an increased reliability of the system, since even overpressure and the use of a metallic ball cannot result in the ball passage through the seat, and the excessive pressure cannot destroy the system during testing of the tubing.

A further feature of the present invention is that said tail part is tubular and has two opposite ends threadingly connected with said hydraulic block and said return block, and wherein said hydraulic block has a plunger which freely extends inside said tubular tail part.

Therefore the tail part does not interact with the plunger to provide turning of the latter and the reliability of the operation of the system in accordance with the present invention is further increased.

Still a further feature of the present invention is that said hydraulic block has a cylinder and a cover provided with a plurality of rows of rubber seals, a fluoroplastic oil removing element, and a rubber-metal dirt removing element, and wherein said cylinder has a piston moving through said cover.

With the cover designed in accordance with these features, it reliably separates the inner closed system of hydraulic pistons from action of an exterior media, including a pressure difference.

In accordance with a further feature of the present invention, said cylinder also has a plunger extending through said piston of said cylinder so that an oil is supplied between an inner surface of said piston and an outer surface of said plunger of said cylinder, which simplifies the construction and prevents clogging of narrow channels.

In the system in accordance with the invention an oil dosing device is provided, having an upper adjustable cover and also a lower cover with a capillary channel formed as a spiral and arranged so that when said upper cover is screwed in it presses a seal against said lover cover. This increases the reliability of operation of the dosing device.

Further, in the inventive system said return block includes a cylinder with a spring unit consisting of two springs having opposite left and right winding directions, and side bearings arranged in points of action of said springs above, below and in a middle of said cylinder of said return block. This also increases the reliability of operation of the system.

In accordance with a further feature of the present invention, said perforator is hollow and has inner channels of identical diameters and identical lengths and formed so that when a liquid flows into an interior of said perforator it changes its trajectory substantially by 90 degrees and exists through nozzles and so that a point of turbulence is located in a center of intersection of axes of said perforator.

Still a further feature of the inventive system is that said perforator has a lower end provided with a stop which is formed so that when the system is lowered, said stop of said perforator is not buried in a sand and thereby allows a return flushing through.

The perforator of the inventive system has reinforcing ribs with a round shape preventing scratching of a casing and damaging of nozzles of said perforator by walls of the casing during lifting and lowering of said perforator.

The perforator of the inventive system has nozzles each having a round opening and a funnel for entering of a working fluid into said nozzle during an operation. The nozzles are composed of a hard alloy of tungsten and carbide with industrial diamond powder.

In addition to a plurality of nozzles, the perforator of the inventive system has a nozzle holder, and said nozzles are welded to an inner surface of said nozzle holder.

The novel features of the present invention are set forth in particular in the appended claims.

The invention itself however, both as to its construction and its manner of operation, will be best understood from the following description of the preferred embodiments, which is accompanied by the following drawings.

DESCRIPTION OF THE PREFERRED EMBODIMENTS

Figure 1:
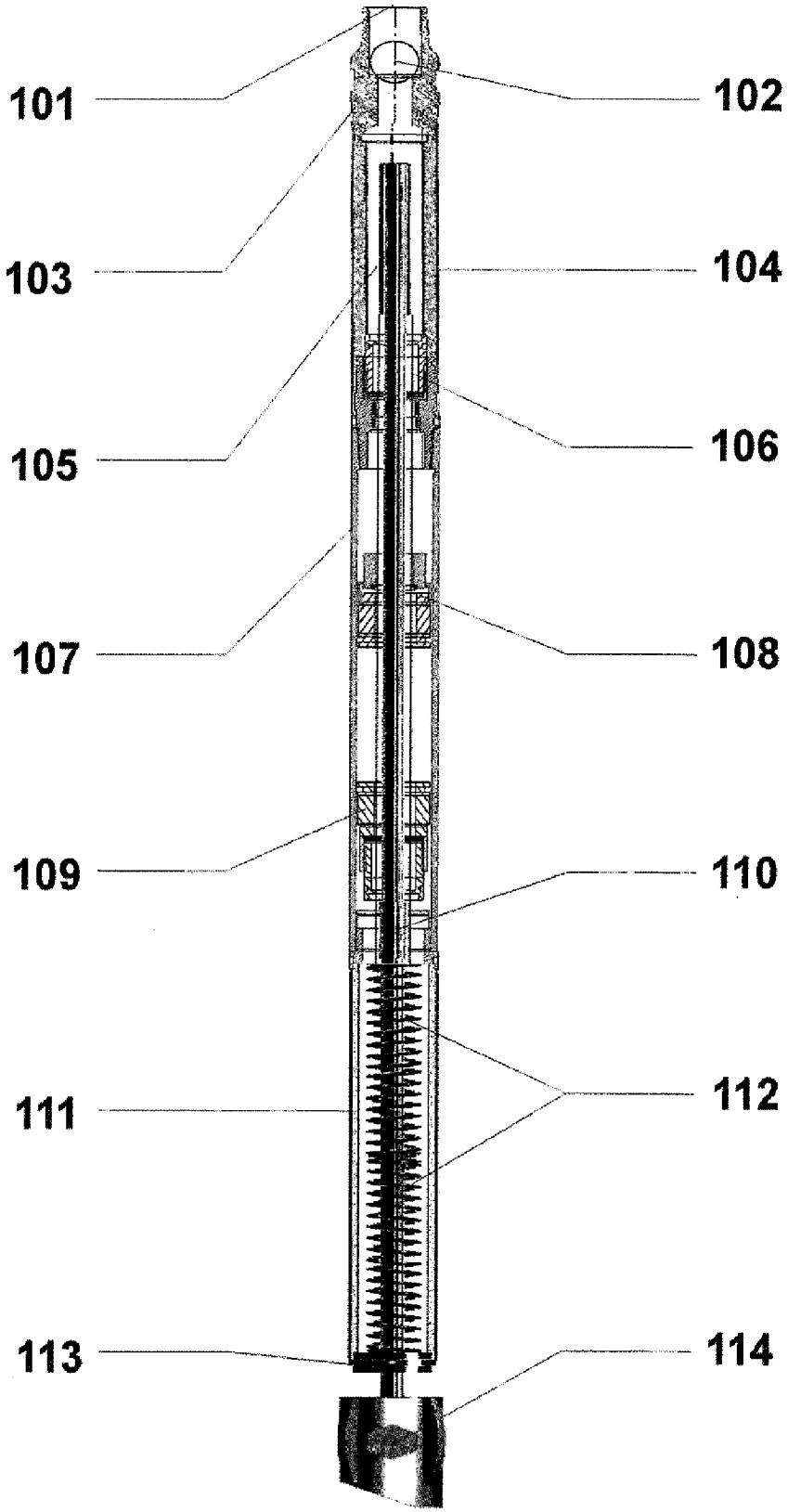
FIG. 1 shown a hydro-slotting perforation system of the invention.
Figure 2:
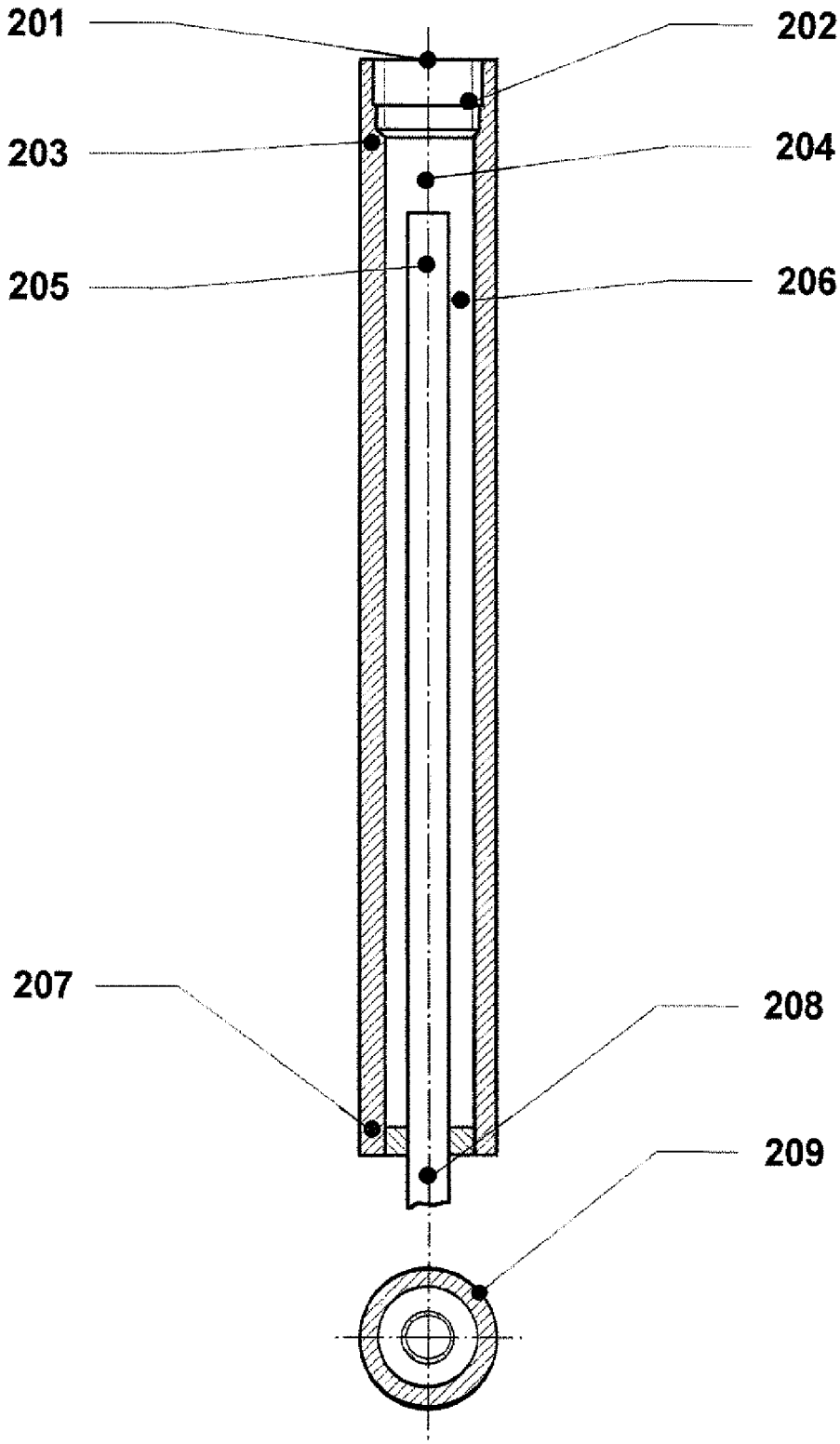
FIG. 2 shows a shank of the inventive system.
Figure 2A:
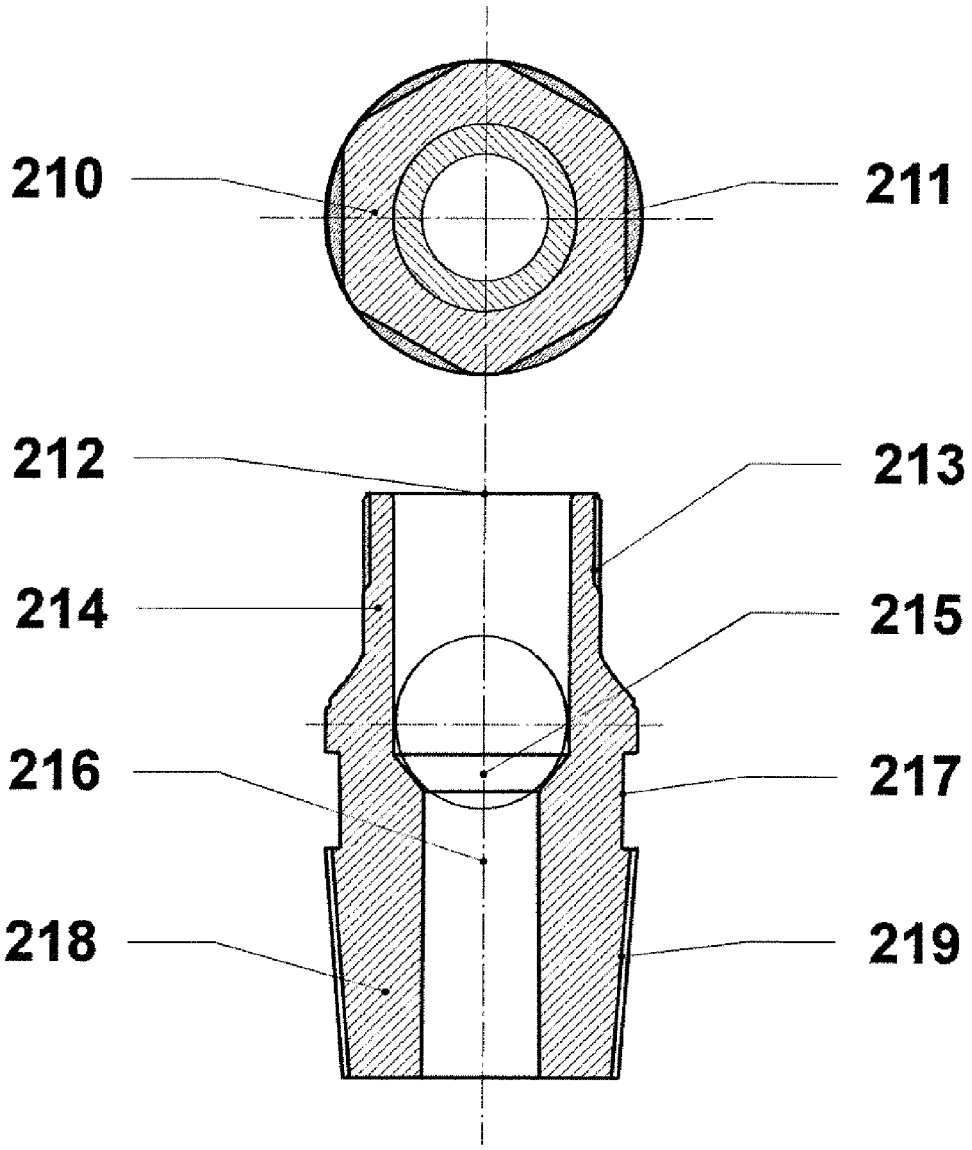
FIG. 2*a* shows an adaptor of the inventive system.

The system in accordance with the present invention includes 4 main components, namely a tail part 104, a hydraulic cylinder 107, a spring cylinder 11 and a perforator 114.

An adapter 101 connects the system to a standard tubing. The adapter is a component of the tail part, but is as a separate element. Forming the adapter and the tail part as a single one-piece element earlier made its manufacture very complicated. A seat 102 is located inside the adapter and constructed for a valve ball for testing whether the tubing sections are hermetic. The ball in the valve closes access of pressure to the hydro-slotting equipment. After the testing, the valve ball is washed to the surfaced by backwashing of the well. Then a metal ball is introduced into the tubing and it freely passes through an opening of the seat, is placed in a seat of the perforator, and closes a direct flow of a working fluid so as to direct it to working nozzles of the perforator.

A lower part 103 of the adapter is connected to an upper section of the tail part by a thread with the use of a pipe tape. An upper section 105 of a rod of the hydraulic cylinder does not have a thread and is in free condition. During the hydro-slotting perforation the working fluid from the adapter is supplied into the tail part and fills it, and then flows through the free end of the rod of the hydraulic cylinder and through the rod of the spring cylinder into an inner space of the perforator which is limited by the metal ball located in the seat of the perforator and the working nozzles, and then it exits the nozzles into an inner well space in form of cutting jets.

An upper hermetic cover 106 of the hydraulic cylinder provides a free stroke of the rod downwardly and upwardly and maintains hermetic closure of the inner space of the hydraulic cylinder from exterior actions from the inner space of the tail part, above the hermetic cover. The hydraulic cylinder has a housing 107. The inner space of the hydraulic cylinder between the upper hermetic cover and the upper valve piston is free in the beginning of the process of the hydro-slotting cutting, and it is filled with a hydraulic oil of a certain viscosity, which flows through a dosing structure of the valve piston during the process of cutting. At the end of the process, this inner space has a maximum volume filled with the hydraulic oil.

The upper valve piston 108 of the hydraulic cylinder is composed of an immovable part fixedly mounted on the rod and a moveable outer part. During movement of the rod under the action of the hydraulic fluid downwardly, the immovable inner part of the valve piston is tightly connected with the outer part and interrupts a flow of oil over the inner space (valve) of the piston, so that a flow is possible only through the dosing device located at a side in the body of the outer moveable part of the valve piston. During the operation the valve piston of the hydraulic cylinder, under the action of force of the rod, approaches the floating piston until it reaches the latter and abuts it against the lower cover of the hydraulic cylinder. All oil from the space between the pistons must flow through the dosing device of the valve piston into a space between the valve piston and the upper cover of the hydraulic cylinder. This corresponds to the extension of the rod over its full length and to a length of the cut slot. The moment of the full extension of the piston over the full length can be also observed on a monitor based on a change in frequency of amplitude fluctuations of a graph of pressure, which is different from the mode of cutting.

A floating lower piston 109 of the hydraulic cylinder provides a hermetic limit of oil space in the inner chamber of the hydraulic cylinder between the upper valve piston and the floating piston. The floating piston also regulates and counteracts an inner pressure of the oil chamber of the hydraulic cylinder between and an exterior hydrostatic pressure inside the inner well space. Therefore the floating piston must not be necessarily located near the lower cover in the lower area of the hydraulic cylinder during the hydro-slotting process.

A lower cover 110 of the hydraulic cylinder is a connecting element between the housing of the hydraulic cylinder and the housing of the spring cylinder. A pipe tape for example of Teflon is used for this purpose. During transportation the lower hydraulic cover remains on the housing of the hydraulic cylinder. At the same time, the lower cover of the hydraulic cylinder is a stop and a limiter for the lower floating piston of the hydraulic cylinder. The lower cover of the hydraulic cylinder does not have a hermetic function and its inner diameter is significantly greater than the outer diameter of the rod.

The spring cylinder 111 has a housing connected to the housing of the hydraulic cylinder by the lower cover 110. A Teflon pipe tape can be used. During the transportation the lower hydraulic cover remains on the housing of the hydraulic cylinder. Two return spring with different winding directions (left and right) are located on the rod of the spring cylinder. The rod of the hydraulic cylinder and the rod of the spring cylinder are connected by a connecting coupling which has an inner conical thread at bot sides. The inner space of the spring cylinder is not hermetic.

The returns springs 112 with opposite winding directions prevent turning of the rod and of the perforator. The springs are lubricated. A lower cover 113 of the spring cylinder serves as an abutment for nuts which are screwed on the rod above the perforator. In the event of sudden lowering of the system onto a ground the nuts abut against the lower cover and protect the system from deformation of the rod or loss of hermetization of the hydraulic cylinder. The lower cover does not have seals over the spring rod. Its diameter is significantly greater than the outer diameter of the rod. In disassembled condition during transportation of the system this cover remains in the spring cylinder.

A perforator 114 is connected with the lower end of the rod of the spring cylinder by the conical thread and often through a coupling, with the use of a Teflon tape. The working fluid under pressure flows through an inner space of the tubing and then through the tail part of the system, through a free end of the rod and into an inner space of the rod of the hydraulic cylinder, and through the inner space of the rod of the spring cylinder into the inner chamber of the perforator. There because of the obstacle made by the metal ball located in the seat of the perforator the working fluid changes its trajectory and is discharged through the nozzles into an inner space of a well.

The tail of the system is formed as a thick-wall pipe with upper and lower threads. It includes two separate components, namely the adapter and the tail part. An upper end 201 of the tail part is connected with the adapter by a conical thread. It has a chamfer 202 for connection with the adapter. A housing 203 of the tail part is constructed so that the upper end of the rod of the hydraulic cylinder can freely move inside it and is not blocked there due to adhesion of sand on it during the operation. The working fluid is supplied from the tubing under pressure into an inner space of the tail part, fills the space, and flows into the perforator through the upper free end of the rod of the hydraulic cylinder. In the beginning of each operation the free inner space of the tail part is minimal, and after full extension of the rod with the perforator it is maximal.

An upper free end 205 of the rod of the hydraulic cylinder has a maximal length in the beginning of each operation, and a minimal length after the full extension of the rod with the perforator. A space 206 between the inner surface of the tail part and the outer surface of the free end of the rod is enlarged so that sand which is transported with the working fluid under pressure from the tubing into the tail part is not compressed between the walls of the rod and the tail part, but instead is washed out from this space by the working fluid which is circulating there.

The lower end 207 of the tail part is connected with the upper end of the hydraulic cylinder by a conical thread connection of the upper hermetic cover of the hydraulic cylinder, with the use of a Teflon pipe tape. During transportation, the tail part remains connected with the hydraulic cylinder. Reference numeral 208 identifies a lower part of the free end of the rod of hydraulic cylinder, while reference numeral 209 identifies the tail part on a view from above. Reference numeral 210 identifies the adapter on a view from above. It connects the tail part with a standard tubing by a conical thread connection, with the use of a Teflon tape. The adapted also serves for testing a hermetic nature of sections by a testing ball placed in the seat of the adapter, which after the testing is washed out to the surface by the back washing. The adapter on its outer surface is provided with recesses for a tool. The adapter is connected by its upper surface 212 with the tubing via the conical thread. The adapter has a body 213, an inner space 214 in its upper part above the seat, a seat 215 for the testing ball, an inner space 216 in the lower part of the adapter below the seat, recesses 217 on the upper surface of the adapter for a tool, a lower part 218 connected with the upper end of the tail part, and a conical thread 218 for connection with the tail part.

The hydraulic cylinder has an upper free end 301 extending into the tail part. It has a hermetic metal plug 302 of the upper cover provided with a conical thread 303 for connection with the tail part. A hermetic upper cover 304 of the hydraulic cylinder also acts as a connecting element for the hydraulic cylinder and the tail part. The upper cover of the hydraulic cylinder has openings 305 over its circumference and serve as capillaries for overflow of oil in the event of overpressure in the hydraulic cylinder in emergency situations and also as opening for a tool. The upper hermetic cover has a seat 308 for placing in the housing of the hydraulic cylinder. An inner space 309 of the hydraulic cylinder between the upper hermetic cover and upper valve piston is filled with oil flowing through the dosing device of the upper valve piston during the process of hydro-slotting.

An immovable inner part 310 of the upper valve rod of the hydraulic cylinder is fixedly placed on the rod by hot pressing. An inner space 311 of the hydraulic cylinder between the valve piston and the lower floating piston is fully filled with hydraulic oil in the beginning of hydro-slotting process. During the operation it flows through the dosing device of the upper valve piston into the upper chamber of the hydraulic cylinder between the upper valve piston and the upper hermetic cover of the hydraulic cylinder. A lower floating piston 312 of the hydraulic cylinder provides a hermetic limit of an oil space in the inner chamber of the hydraulic cylinder between the upper valve piston and the floating piston. The floating piston also regulates and equalizes an inner pressure of the oil chamber of the hydraulic cylinder between the valve piston and the floating piston and an external hydrostatic pressure inside a well space. Therefore in the process of the hydro-slotting operation the floating piston is not always located near the lower cover at the bottom of the hydraulic cylinder.

A tail part of the lower floating piston 313 has a hermetic connection with the piston and a dirt-removing member from the side of the working rod and forms a limiting component of the system of hydraulic cylinders with the working rod in the lower cover of the hydraulic cylinder. Abutment takes place during a full exit of the rod with the perforator at the end of the hydro-slotting operation. A lower cover 314 of the hydraulic cylinder connects the housings of the hydraulic and spring cylinders and provides a stop for the lower floating piston of the hydraulic cylinder. A Teflon pipe tape is used for the connection, however the inner space is not hermetic and the inner diameter is greater than the outer diameter of the rod. The lower cover stays on the hydraulic cylinder during transportation. The lower cover is provided with openings over a circumference of its body, for a tool.

A stop edge 316 of the lower cover of the hydraulic cylinder between two connecting threads has the same outer diameter and the whole system. A lower thread 317 of the cover of the hydraulic cylinder is provided for connection with the spring cylinder. A Teflon pipe tape is used for connection, but the inner space is not hermetic and the inner diameter is greater than the outer diameter of the rod. It also stays on the hydraulic cylinder during transportation. A lower end 318 of the working rod of the hydraulic cylinder is connected with a rod of the spring cylinder by a connecting coupling which has identical inner conical threads on both sides. Sometimes end transition coupling are used for this connection, and they have identical inner and outer threads for maintaining a required service life of the rod thread. The upper hermetic cover is associated with an upper end 319 of the rod of the hydraulic cylinder, which extends into the tail part. A hermetic metal plug 320 is provided in the upper cover of the hydraulic cylinder, and a system of inner hermetic gaskets 321 is located inside the hermetic metal plug. An outer conical thread 322 of the hermetic plug fixes the upper cover from its outer side, and a conical thread 323 of the upper hermetic cover is used for connection to the tail part 303, wherein a body of the upper hermetic cover of the hydraulic cylinder 325 is identified as 324. The lower part of the tail part has a stop 326 against an upper hermetic cover of the hydraulic cylinder.

Figure 3:
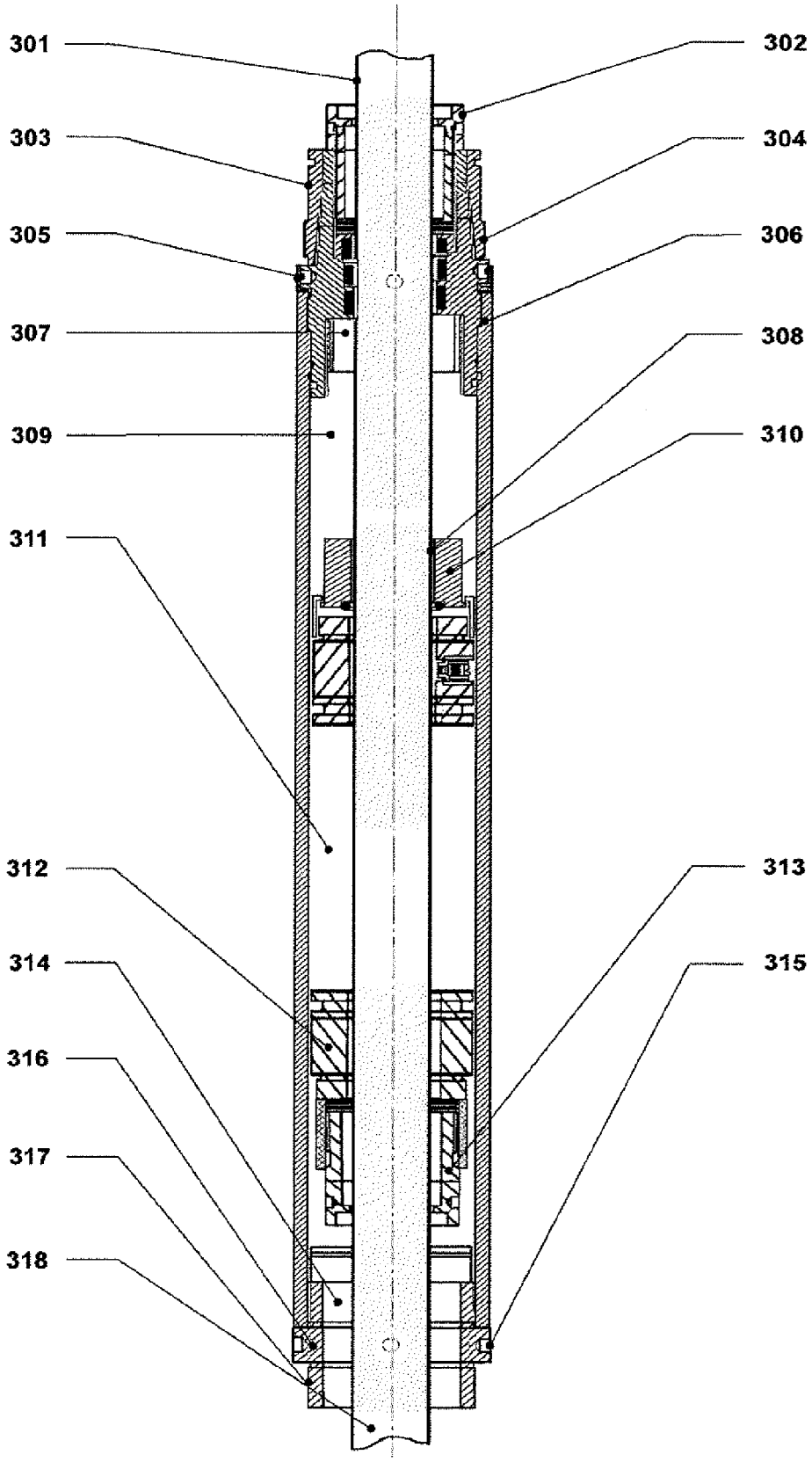
FIG. 3 is shows a hydraulic cylinder of the inventive system.
Figure 3A:
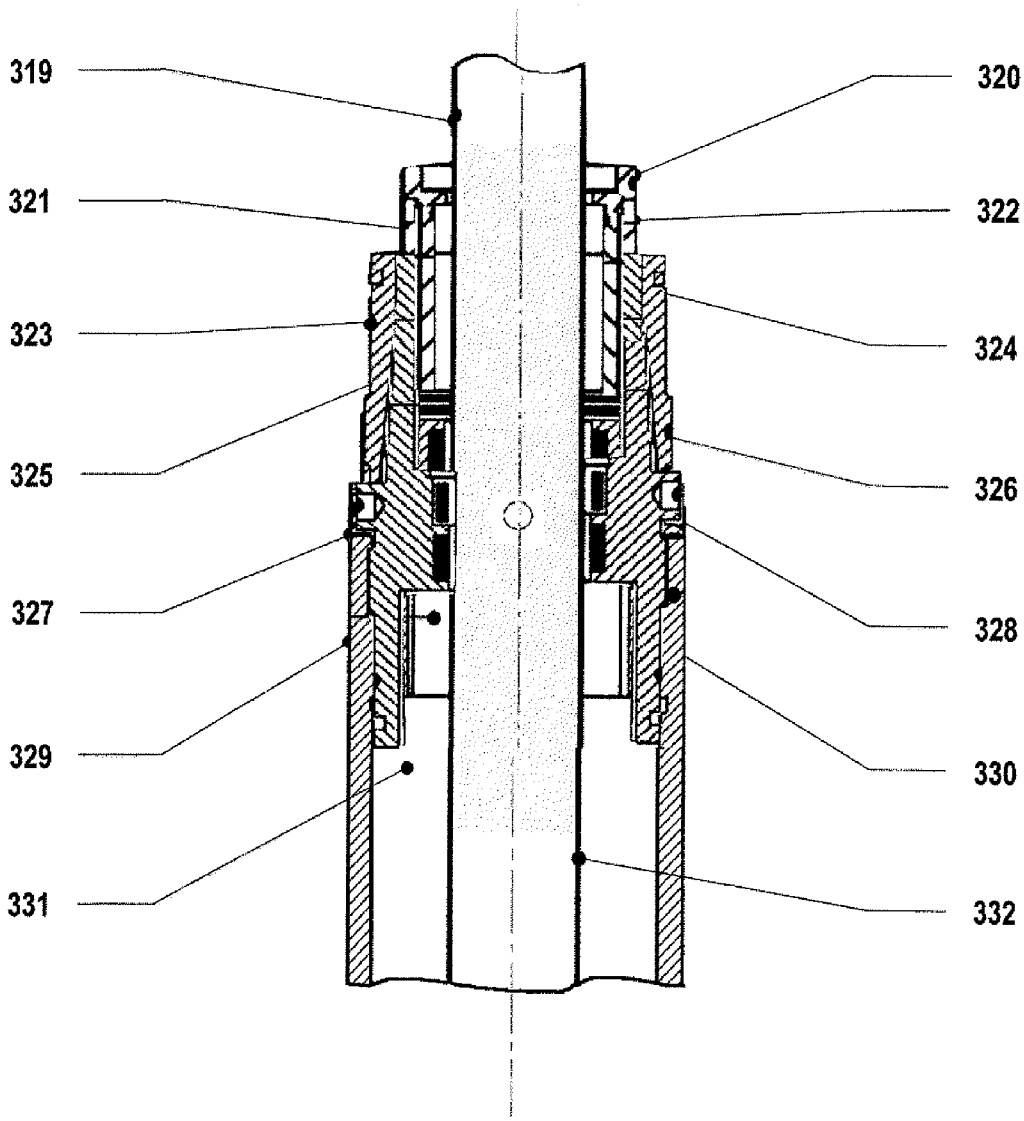
FIG. 3*a* shows a top cap of the hydraulic cylinder.
Figure 3B:
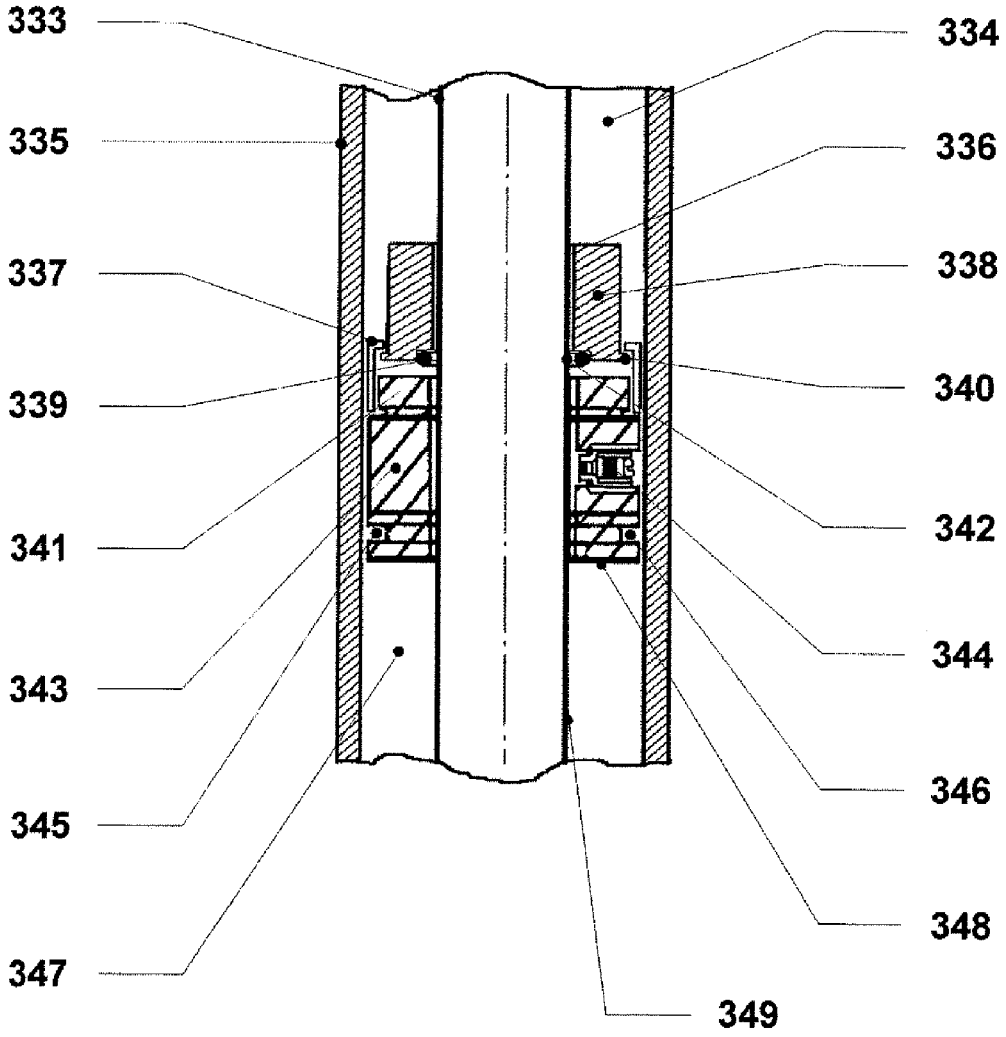
FIG. 3*b* shows a valve piston with a dosing device.
Figure 3C:
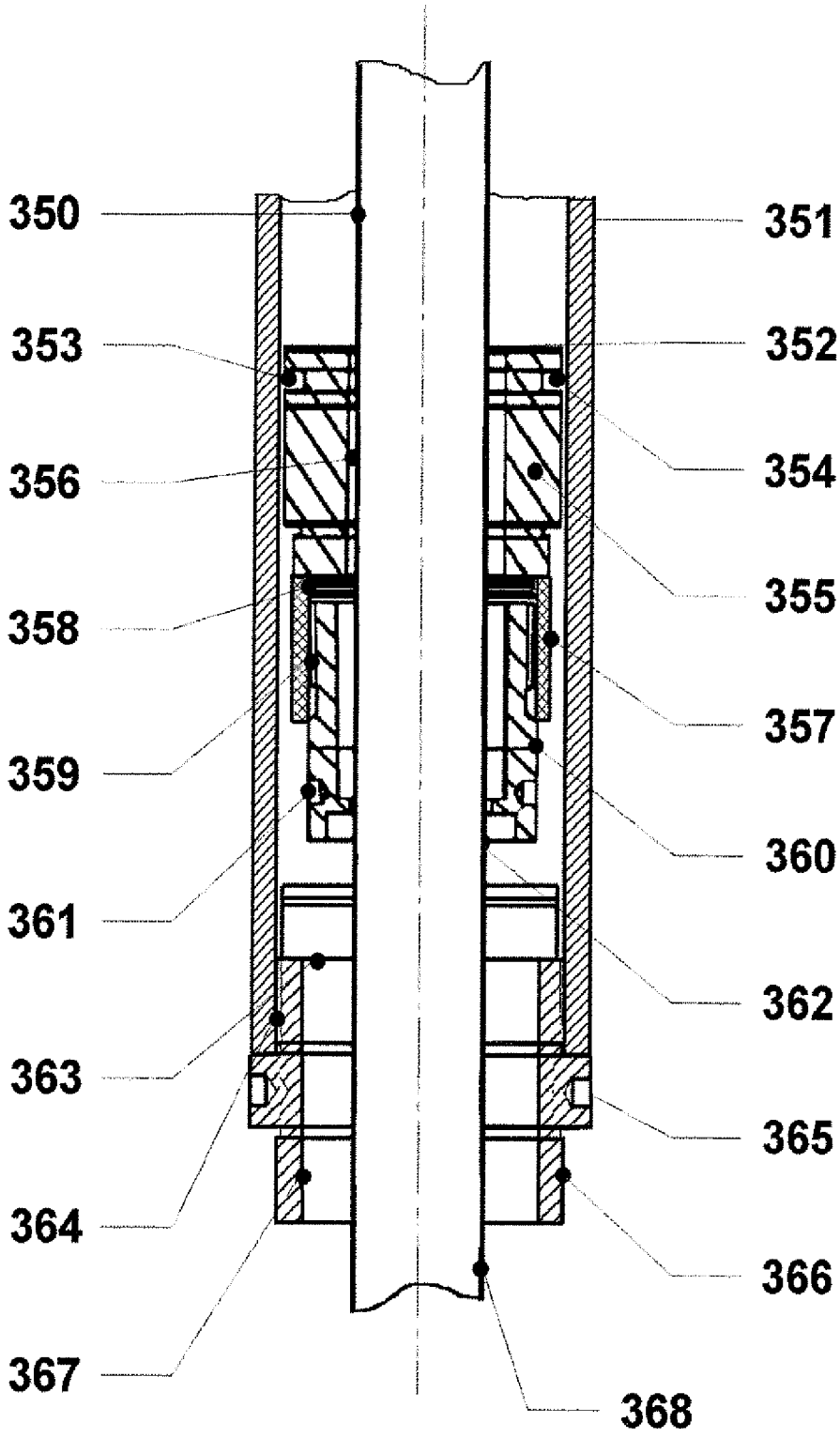
FIG. 3*c* shows a floating piston and a lower cap.

A body of the upper hermetic cover of the hydraulic cylinder has openings 327 provided on a circumference and used as a capillary for an overflow of oil in case of an overpressure as a result of failure, and as openings for a tool. A hermetic rubber seal 328, such as an O-ring, is arranged between the upper hermetic cover and the housing of the hydraulic cylinder. An upper part of the hydraulic cylinder is identified as. An upper part of the hydraulic cylinder is identified as 329, and the cover is screwed into it at 330. An inner space 331 of the hydraulic cylinder between the upper hermetic power and the upper valve piston is filled with oil which flows through the dosing device of the upper valve piston in the process of the hydro-slotting operation, and in the beginning of the process it is not filled with the hydraulic oil 309. A portion 332 of the working rod of the hydraulic cylinder extends in a space between the upper hermetic cover and the upper valve piston in FIG. 3*a*, and a portion 333 extends in a space between the upper hermetic cover and the upper valve piston in FIG. 3*b*.

An inner space 334 of the hydraulic cylinder between the upper hermetic cover and the upper valve piston is filled with oil, which flows through the dosing device of the upper valve piston during the process of the hydro-slotting operation, while in the beginning of the process it is not filled with oil. A housing of the hydraulic cylinder in the region of the upper valve piston is identified as 335. A lower immovable inner part 336 of the valve piston is fixedly arranged on the rod by hot pressing. A rear (upper) stop bush 337 of the valve piston is connected with its lower part by a straight thread and limits a stroke of the head part of the valve piston on the immovable inner part, for opening and closing of the inner valve and overflow of oil through the inner space of the piston during the placement of the system into the initial position by a return spring. The immovable inner part 338 of the upper valve piston is fixedly arranged on the rod by hot pressing. A rubber ring 339, such as an O-ring, is inserted partially into the inner part of the valve piston. During movement of the rid downwardly in the process of the hydro-slotting cutting the head part of the valve piston is freely displaced by pressure of the working fluid on the rear stop bush, is tightly pressed to the immovable part and the rubber seal, and interrupts access of the hydraulic oil for overflow through the inner space of the valve piston, and thereby only one part is left through the dosing device. During movement of the rod upwardly, when the pressure is removed and the system is placed into the starting position, the valve piston is relaxed and opens a path for overflow of oil into inner spaces of the valve piston This reverse process takes place faster that the direct process (through the dosing device), and thereby the system is moved to its initial position in a few seconds.

A stop 340 of the rear upper bush limits a length of movement of the valve piston relative to it immovable part. A thread 341 connects the piston with its rear stop part. The piston has a limited inner space 342, over which the head part can move out from the immovable rod part. A body of the valve piston or its head moveable part is identified as for overflow through the inner space of the valve piston, and thereby only one part is left through the dosing device. During movement of the rod upwardly, when the pressure is removed and the system is placed into the starting position, the valve piston is relaxed and opens a path for overflow of oil into inner spaces of the valve piston This reverse process takes place faster that the direct process (through the dosing device), and thereby the system is moved to its initial position in a few seconds.

A stop 340 of the rear upper bush limits a length of movement of the valve piston relative to it immovable part. A thread 341 connects the piston with its rear stop part. The piston has a limited inner space 342, over which the head part can move out from the immovable rod part. A body of the valve piston or its head moveable part is identified as 343. A dosing device 344 is one of the main components of the hydraulic cylinder and of the system. The speed of movement of the rod with the perforator and thereby the speed of cutting are determined by a quantity of hydraulic oil flowing through the dosing device under pressure and a speed of its flow.

The body of the valve piston has a groove 345 for a rubber and an outer hermetic ring, providing hermetic closure of the inner hydraulic piston system During assembly and placement of the working pistons on the rod a special member is used with a lower diameter than the inner diameter of the hydraulic cylinder and it is screwed into a thread connect ion of the hydraulic cylinder. A place for installation of hydraulic piston ring placed on the sealing ring is identified as 346.

An inner space 347 of the hydraulic cylinder between the upper valve piston and lower floating piston in the beginning of the process of hydro-slotting cutting is filled with oil, which flows during the process through the dosing device of the upper valve piston in to the upper space of the hydraulic cylinder between the upper valve piston and the upper hermetic cover of the hydraulic cylinder. Reference 348 identifies a working (mirror) surface of the valve piston. The working rod of the hydraulic cylinder in the space between the upper valve piston and the lower floating piston is identified as 349. The working rod of the hydraulic cylinder in the space between the upper hermetic cover and the upper valve piston is identified as 350. The housing of the hydraulic cylinder in the region of the lower floating piston is identified as 351. The floating piston providing a hermetic limit of the oil space in the inner chamber of the hydraulic cylinder between the upper valve piston and the floating piston. The floating piston also regulates and equalizes the inner pressure of the oil chamber of the hydraulic cylinder between the valve piston and the floating piston and an external hydrostatic pressure inside the well space. The floating piston is not necessarily located near the lower cover in the operation.

The working (mirror) surface of the lower floating piston is identified as 352. The lower floating piston has a groove 353 for an inner rubber seal and an outer Teflon seal for hermetic sealing of the inner hydraulic piston system. Reference 354 identifies a location for placement of the hydraulic piston Teflon ring, placed on the rubber ring.

The lower floating piston of the hydraulic cylinder has a body 355, an inner placement surface 356 and a rear part 357. The floating piston can move freely along the working rod. It provide a limit for an oil space in the inner chamber of the hydraulic cylinder between the upper valve piston and the floating piston. The floating piston regulates and equalized the inner pressure of the oil chamber of the hydraulic cylinder between the valve and floating pistons and an exterior hydrostatic pressure inside the well space. This is why during the hydro-slotting operation the floating piston is not necessarily located near the lower cover at the bottom of the hydraulic cylinder.

A hermetic metal plod with a system of hermetic gaskets is fixed at the rear part of the floating piston. The hydraulic cylinder does not have in its lower area an additional hermetic cover, as at the upper end, since the floating piston provides a hermetic closure between the working and exterior space. The system of hermetic gaskets between the inner part of the floating piston and the metal plug is identified as 358. The floating piston is connected with the metal hermetic plug by a thread 359, and the metal hermetic plug has a body 360 with openings 361 over its circumference for a tool.

A dirt removing member 362 in the lower part of the metal plug prevents entraining of sand particles of a working fluid, particle of rock, etc. inside the inner space of the hydraulic cylinder and provides to the extent the initial hermetic closure from the side of the floating piston.

A stop 363 is provided for the lower floating piston of the lower cover of the hydraulic cylinder The lower cover serves for connection of the bodies of the hydraulic and spring cylinders and as a stop for the lower floating piston of the hydraulic cylinder. A Teflon pipe is used for connection, but the inner space is not hermetic and the inner diameter is greater than the outer diameter of the working rod.

The body of the lower cover of the hydraulic cylinder has opening 365 along its circumference for a tool. The lower cover of the hydraulic cylinder is connected with the spring cylinder by a thread 366, and a Teflon pipe tape 367 is utilized. A lower end 368 of the working rod of the hydraulic cylinder is connected with the rod of the spring cylinder by a connecting coupling having identical threads at both sides, and a Teflon pipe tape can be used.

A dosing device 369 is provided in an upper valve piston and is threaded into the body of the valve piston. A Teflon disc is used for better hermetic properties.

The dosing device of the system is located at the side in the body of the floating (head) part of the valve cylinder, so that with the closed position of the movable and immovable (fixed) parts of the piston and the closed valve between the inner space and the working rod, the hydraulic oil in the hydraulic cylinder between the pistons can not flow through the inner valve.

However, oil can reach the beginning, the lower end, of the dosing device through one of two or four channels. The common line of the circumference of the channels does not go beyond the rubber ring inserted in the immovable part of the piston, serving as a valve. Otherwise the inner valve of the piston would not close the flow of oil along its inner cavity. These conditions are created during movement of the working piston downwardly under the action of pressure of the working fluid during cutting of a slot in hydro-slotting operation.

Hydraulic oil between the floating and valve pistons of the hydraulic cylinder reaches a lower end of the dosing device. Oil presses through a filter 388 composed of metal net, flows into a lower stage of the dosing device 387 formed as a return funnel for covering a larger area of oil, which through the upper opening 386 of the lower stage of the dosing device reaches a next stage formed by a system of capillaries. The lower stage is pressed from below into the body of the dosing device 382 composed of a stronger metal. The outer surface of the body of the dosing device is a straight thread for threading of the dosing device into the body of the valve piston with openings having a corresponding thread. The inner surface of the dosing device also has a straight thread.

Small cut in form of capillaries are provided on the outer surface of the lower stage of the dosing device. They are efficient for flowing of oil under pressure, instead of a valve-type dosing device, and formed in accordance with Archimedes spiral. 382 shows a lower section of the dosing device from above, from the side of the Archimedes spiral.

Hydraulic oil passes through the openings from above, and in a center of the lower section of the dosing device starts flowing along the spiral capillary cuts from a center to a periphery. From above the capillary spiral is tightly pressed by a fluoroplastic peg 378 which has an increased stretching and is pressed into the spiral capillary cuts when pressed against the upper surface of the lower section of the dosing device. With the degree of pressure on the fluoroplastic peg it is possible to regulate a volume of the flowing oil in a certain time period and therefore to regulate a speed of movement of the valve piston and the work. This is how the hydro-slotting system is regulated for a required cutting speed in dependence of temperature and viscosity of oil. The fluoroplastic peg is fixed over its outer diameter by a tin or copper ring which prevents a complete squashing of the fluoroplastic.

The fluoroplasic peg is pressed by a metal peg which has a flat surface at the bottom and a small cone at the top 377. The metal peg in turn is pressed by the upper cover or section of the dosing device 370. The upper cover is fixed in the body of the dosing device by means of a straight thread which is an outer thread on the cover and an inner thread on the body. Hydraulic oil passes through the capillary spiral and flows between the walls of the fluoroplastic peg and the inner walls of the dosing device, and then between the walls of the metal peg and the inner walls of the dosing device and flows on top of the metal peg having a conical surface. The oil is now located in a space between the conical surface of the metal peg from below and the cover or upper section of the dosing device from above.

Figure 3D:
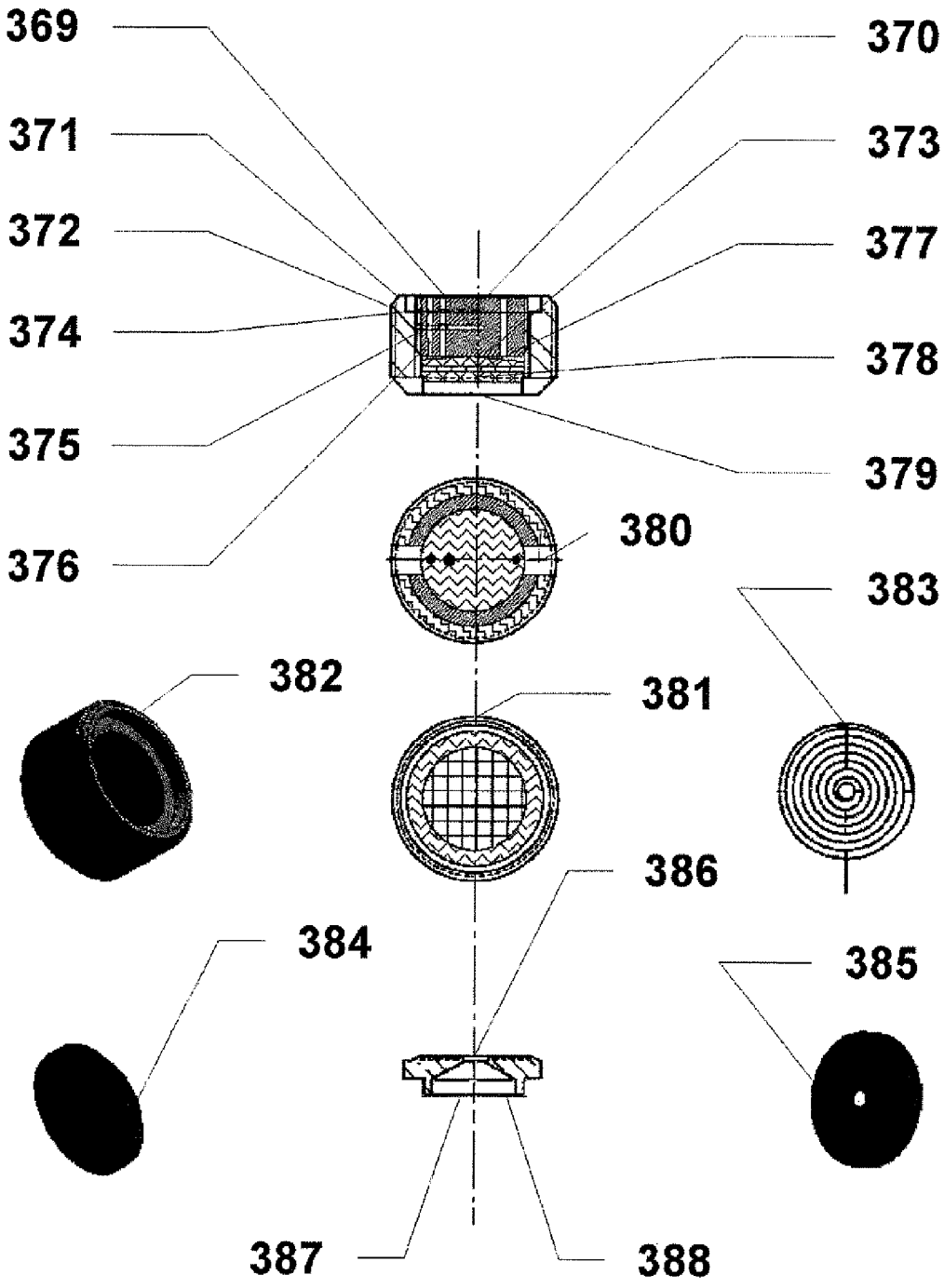
FIG. 3*d* shows the dosing device.
Figure 4:
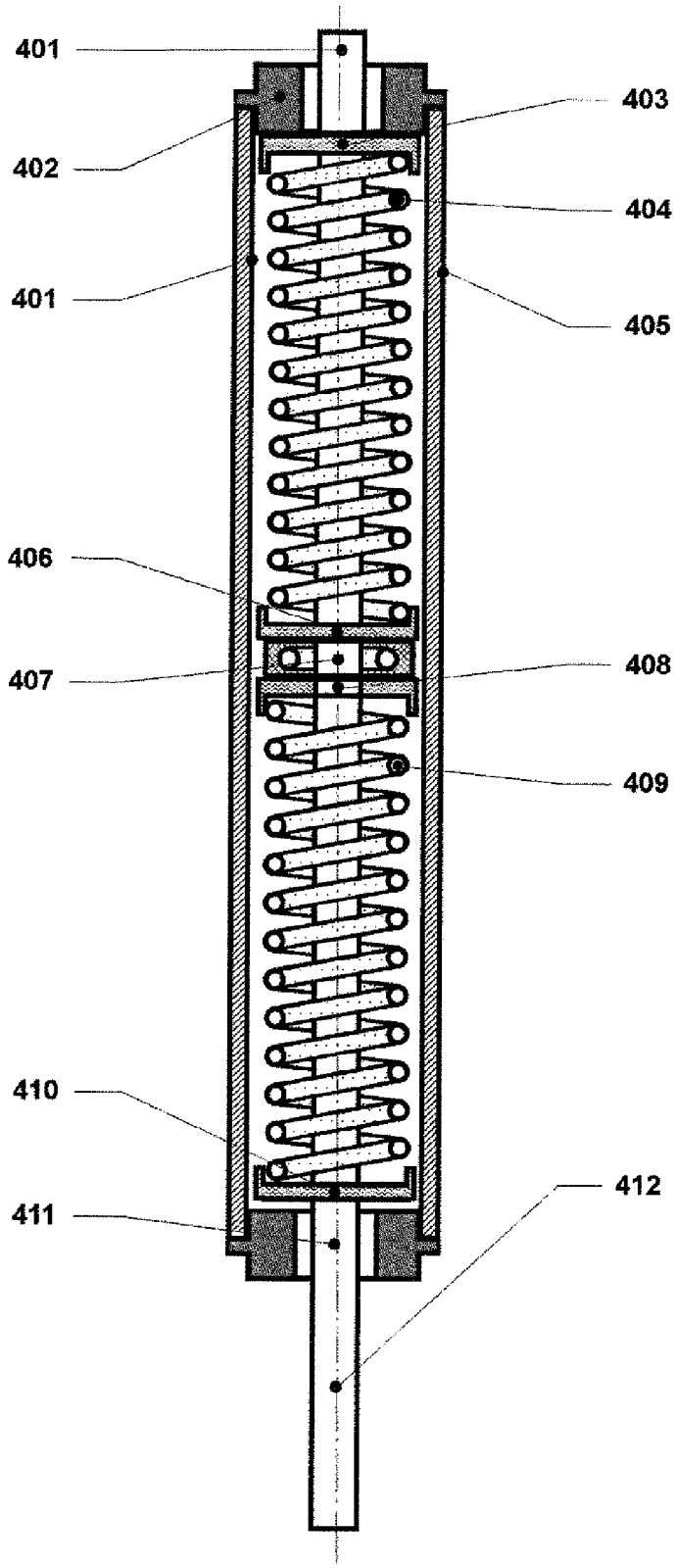
FIG. 4 shows a spring cylinder.
Figure 4A:
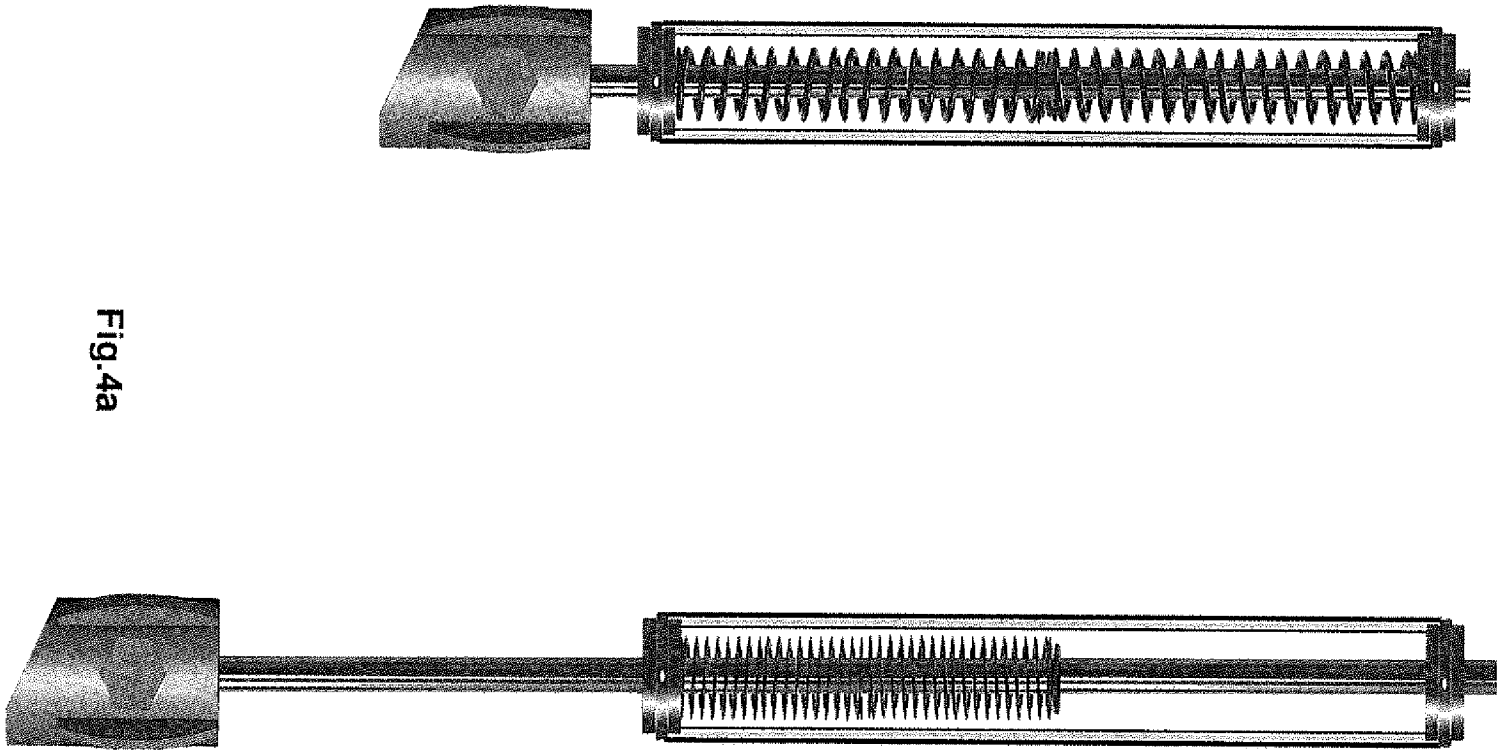
FIG. 4*a* shows another view of the spring cylinder.
Figure 5:
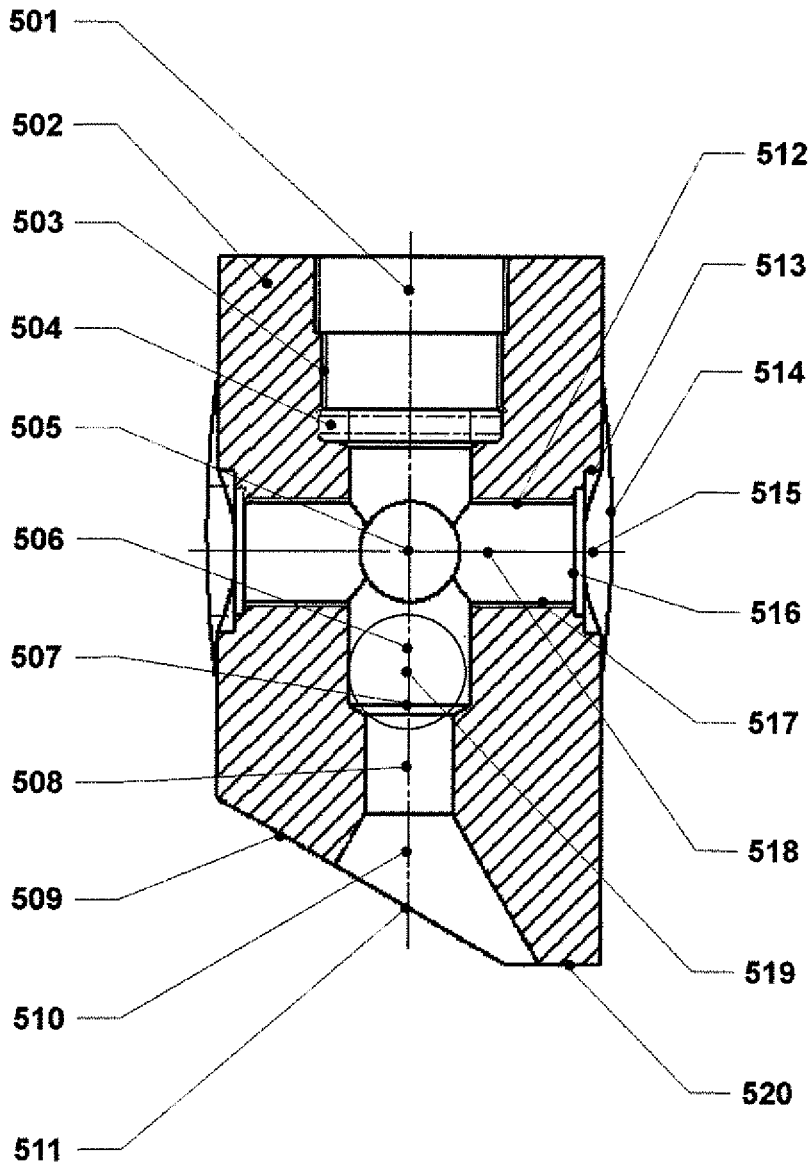
FIG. 5 is shows a hydro-slotting perforator.
Figure 5A:
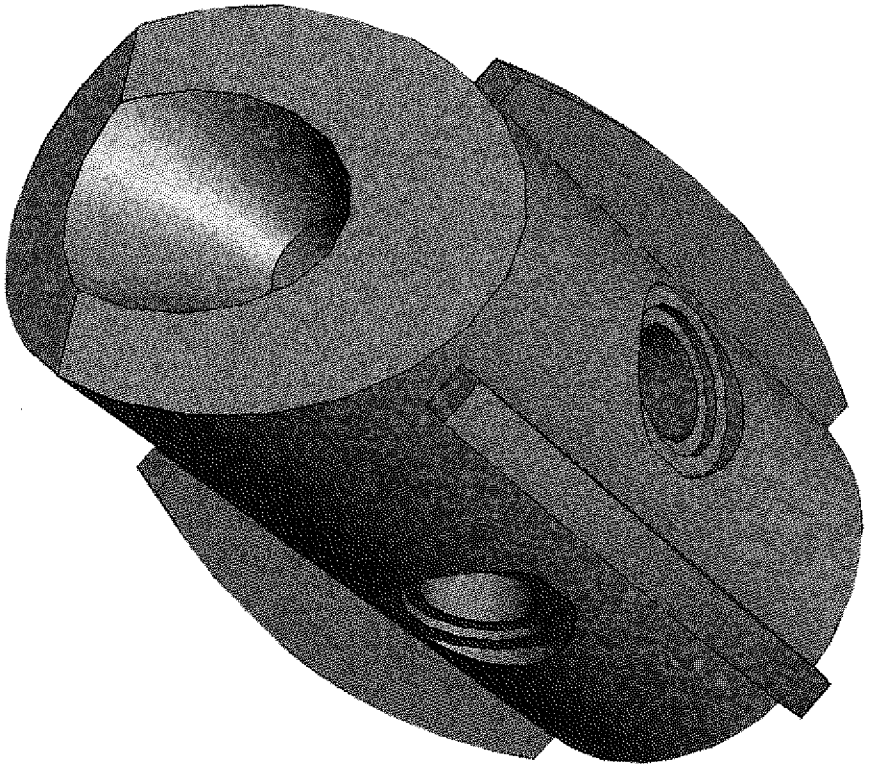
FIG. 5*a* shows a general view of the perforator.
Figure 5B:
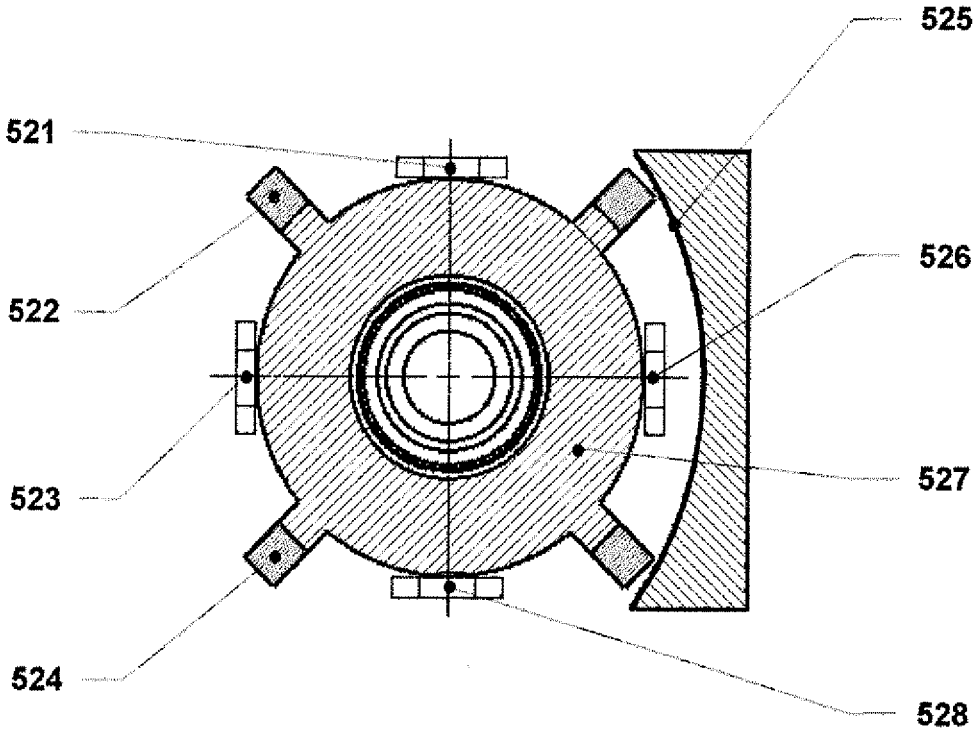
FIG. 5*b* shows a top view of the perforator.
Figure 5C:
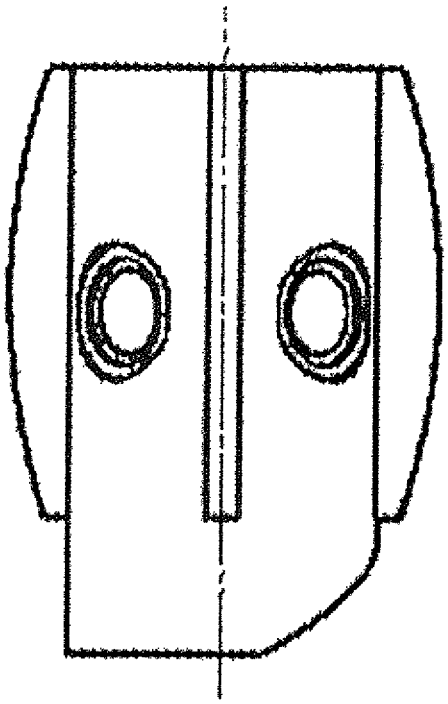
FIG. 5*c* shows a side view of the perforator.
Figure 5D:
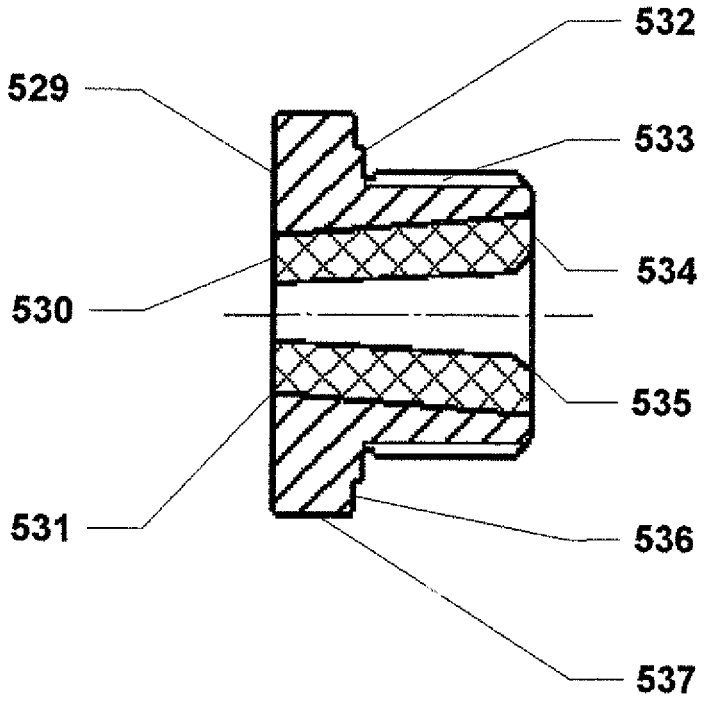
FIG. 5*d* shows a nozzle with a holder.
Figure 5E:
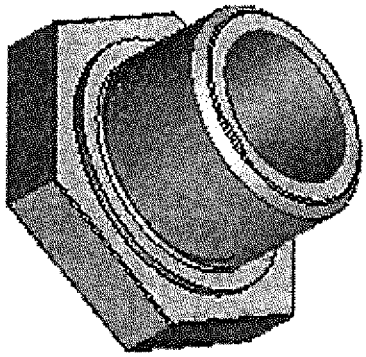
FIG. 5*e* shows a general view of the nozzle holder.
Figure 5F:
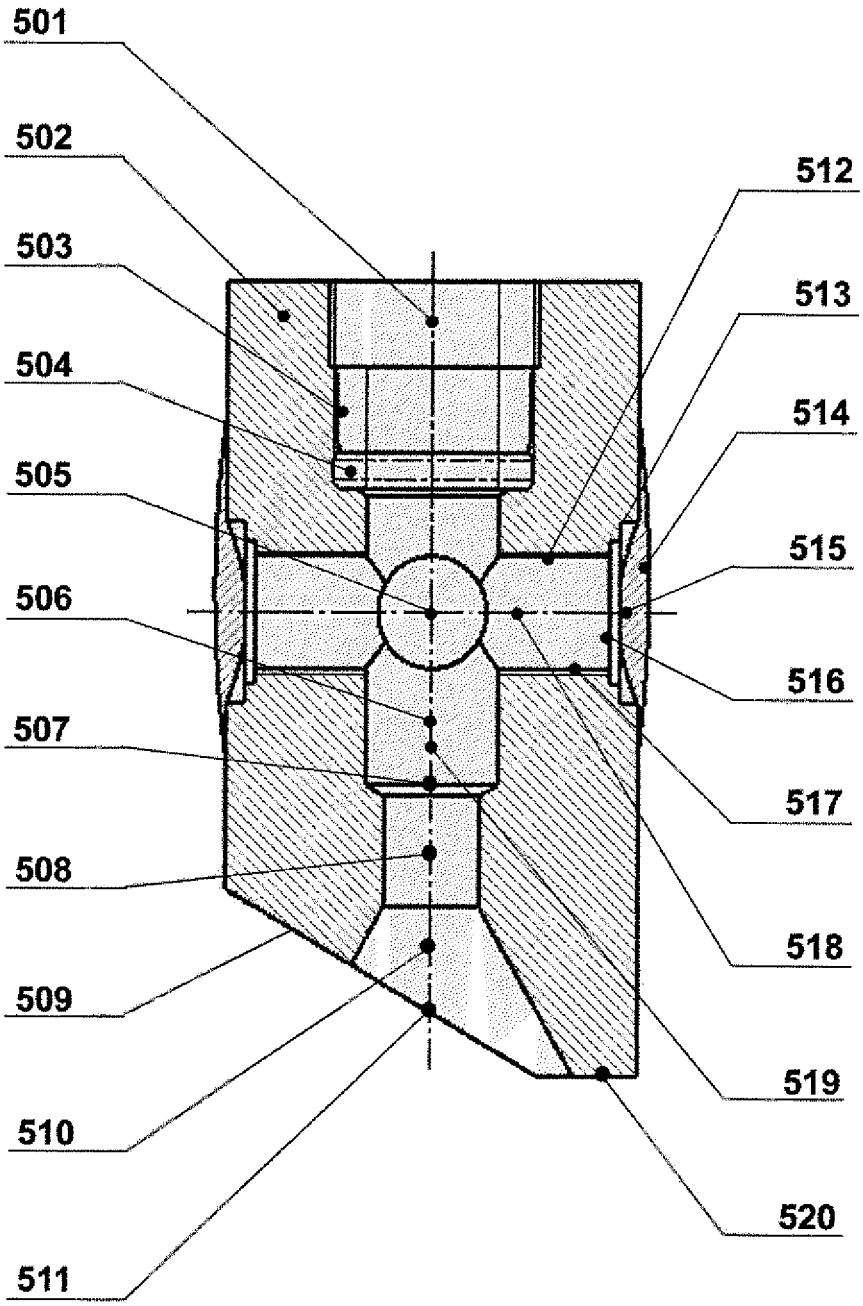
FIG. 5*f* shows a linear scheme of the perforator.
Figure 5G:
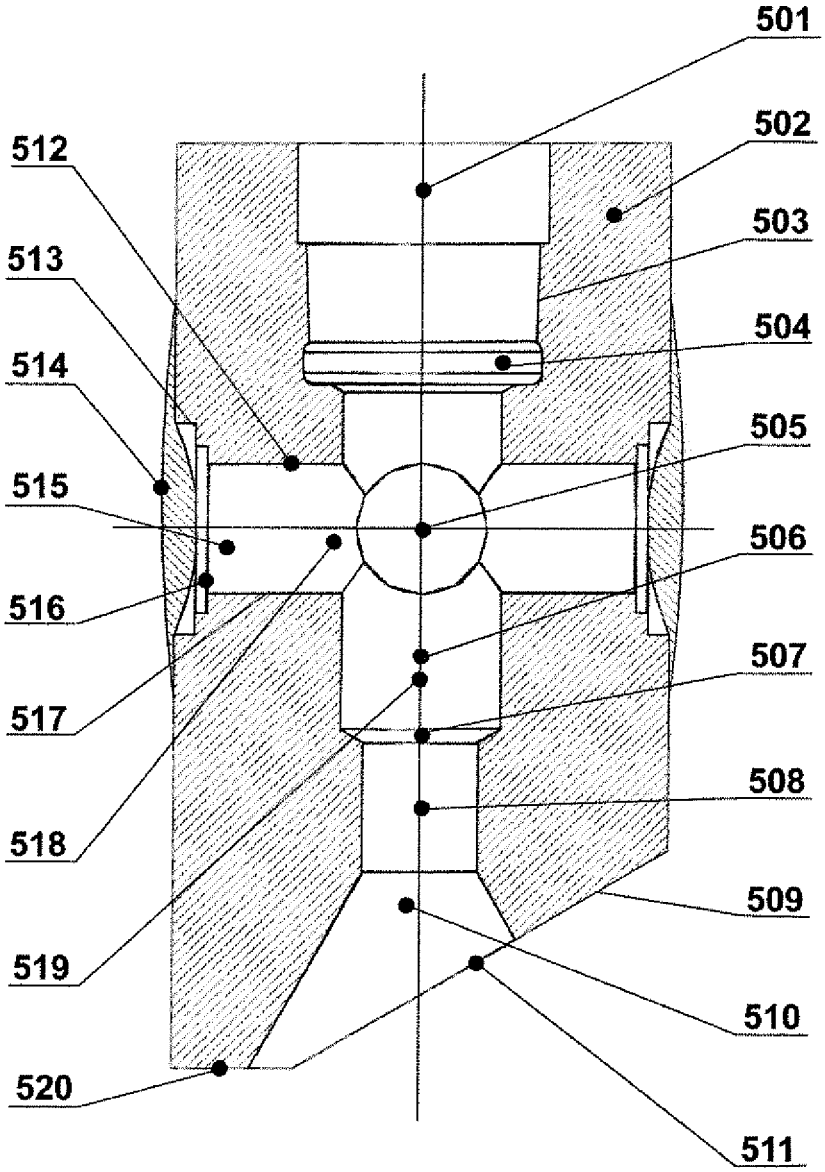
FIG. 5*g* shows internal surface of the perforator.
Figure 5H:
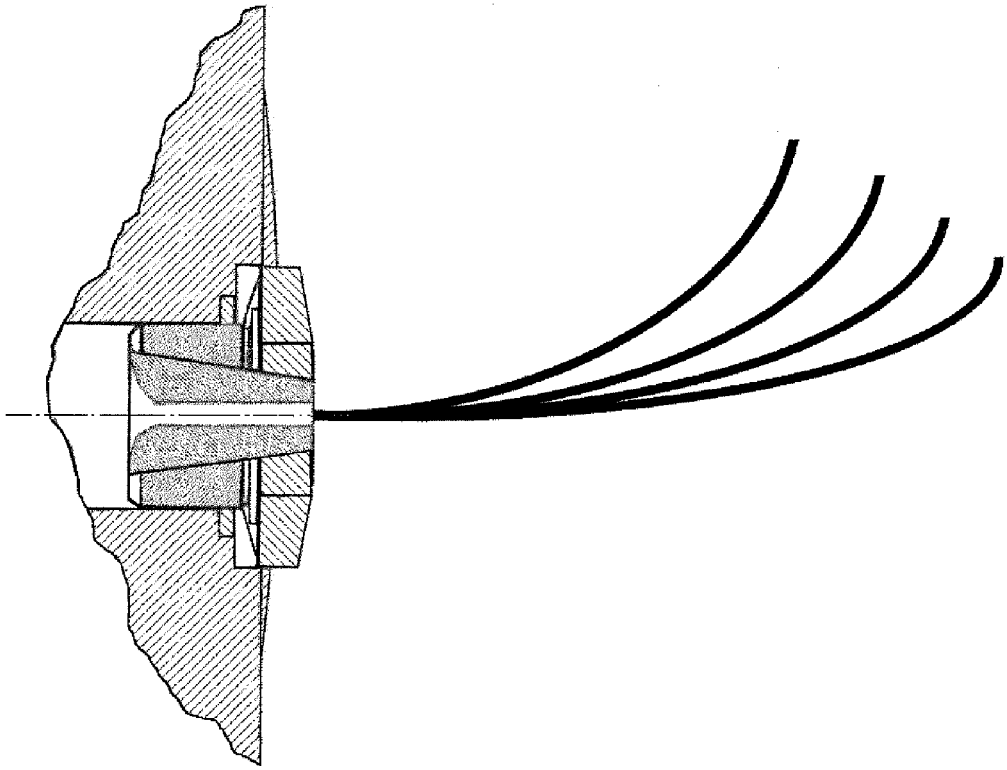
FIG. 5*h* shows a trajectory of working fluid jets.

The upper cover (upper section) of the dosing device 370 (FIG. 3*d*) has two (or sometimes three or four) openings in its body 731 (FIG. 3*d*). or on the top view 38 (FIG. 3*d*). Oil flows through these openings from the space under the cover outwardly into a zone between the walls of the valve piston and the outer wall of the hydraulic cylinder, and therefore into a space between the valve piston and the upper hermetic cover of the hydraulic cylinder, that takes place during the process of hydro-slotting cutting.

In order to prevent unscrewing of the upper cover or section of the dosing device, it has a special cut through 372 (FIG. 3*d*), and in an upper opening 376 (FIG. 3*d*) and on the top view 380 (FIG. 3*d*) a screw with sunk head is screwed. By tightening of this screw, the cover of the dosing device is fixed and does not unscrew from vibration of the system during the cutting. The screw and the opening for it can be located at a side of oil channels and in a middle of the upper cover or section of the dosing device.

A dosing device of the hydro-slotting system is identified as 380 (FIG. 3*d*) on a top view and 381 on a bottom view. When the rod moves downwardly under the action of pressure of the working fluid, the immovable inner part of the valve piston is tightly connected with the outer part and interrupts an overflow of oil along an inner space (valve) of the piston, providing a possibility for an overflow only through the dosing device located at a side in the body of the outer movable part of the valve piston. During the operation the valve piston of the hydraulic cylinder, under the action of force of the rod, approaches the floating piston until it reaches the latter and presses it against the lower cover of the hydraulic cylinder. The oil will flow from the space between the pistons through the dosing device of the valve piston into a space between the valve piston and the upper cover of the hydraulic cylinder. This will correspond to extension of the working rod for its full length and the length of the cut slot. A moment of exit of the piston over its full length can be observed on a monitor based on changes of frequency of amplitude fluctuations of the working fluid, different from the mode of cutting.

A spring cylinder returns the rod with the perforator to an initial position when the pressure of the working fluid lowers to 0, and the hydro-slotting system is ready for a next interval of cutting. In the present invention the length of the spring cylinder is reduced, which is important for use of the system in horizontal wells which have a limited radius of transition of well from vertical to horizontal. The length reduction of the spring cylinder results in reduction of a total length of the hydro-slotting system including the perforator.

An upper end 401 of the rod of the spring cylinder is connected to the body of the hydraulic cylinder by a thread by means of a connecting coupling which has an inner thread on both ends and facilitates an assembly of the hydra-slotting system when delivered to the place of use. The spring cylinder has an upper cover 402 for connecting the body of the spring block with the body of the hydraulic cylinder and simultaneously forms a stop for return springs in the body of the spring cylinder. The upper cover is also a lower cover of the hydraulic cylinder and serves as a lower stop for he floating piston. It does not have hermetic seals over the spring rod. An upper stop gasket 403 is provided for the spring, and sometimes can be replaced by a bearing. 404 is an upper spring. Two compression springs of different direction of winding are used in the spring cylinder. A body 405 of the spring cylinder corresponds to an outer diameter of the hydro-slotting system along its whole length, which makes it universal for use in wells with different sizes and diameters of well casings.

A medium upper stop gasket 406 is provided for the spring and is identical to the gasket 403. A double-acting bearing 407 is used to prevent twisting stresses during compression of the springs. A medium lower stop gasket is identical to the gaskets 403, 406, 408. The spring cylinder has a lower cover 411 formed as a stop for the return springs in the body of the spring cylinder, and also as a stop for nuts that are screwed on the rod above the perforator. If the system is accidentally suddenly lowered onto the ground, the nuts abut against the lower cover and prevent deformation of the rod or hermetization loss of the hydraulic cylinder. The lower cover does not have hermetic seals over the spring rod. A lower end 412 of the rod of the spring cylinder is connected with a perforator by thread and with the use of a Teflon pipe tape.

In the inventive system two different-direction springs (left and right) are used under the stop gaskets on the upper and lower ends, the double-acting bearings are located in the middle, an inner diameter of the spring is increased, and the rod is chromium-plated along the whole length of the surface. This significantly reduces friction of the spring against the rod twisting stresses are prevented by the bearings, and the movement of the perforator has an unchangeable rectilinear direction along the wall.

The perforator of the system converts the flow of the working fluid into two (to four) working jets depending on the quantity of working nozzles and stop screws. The working jets cut the casing, the cement ring and rock behind the cement ring. The perforator is constructed to provide straight and return washing of the well and the tubing, to supply different liquid components into the well and to produce mini hydro cracks. The perforator is fixed on the extendable working end of the spring cylinder by a connecting coupling having conical threads at the ends of the rod and of the perforator.

A space 501 is provided for fixing of the perforator on the rod of the spring cylinder by a connecting coupling. The perforator has a body 502 and is connected to the rod of the spring cylinder by a conical thread 503 with the use of a Teflon pipe tape. A sealing ring 504 provide a hermetic connection of the perforator with the coupling to prevent leakage of the working fluid along the tread. Inside the perforator there is a turbulence zone of working fluid 505, in which the flow of the working fluid is subdivided into several flows which, through the nozzles, cut the casing, the cement ring and the rock.

The perforator has a valve zone for a metal ball which closes an opening in its lower part. When the opening is open, it allows liquid to flow in both directions for direct and reverse washing of the well. The metal ball operates as a valve which closes the opening in an end part of the perforator, so that the working fluid exits only through the perforator nozzles and provides working cuts. With the reverse washing the ball is moved to the surface without lifting of the whole system. Then the direct and the reverse washing of the well can be carried out again. 507 is a seat for the metal ball, and it does not have straight corners and sharp edges, so that the metal ball seats tightly in the seat, does not vibrate, and is not displaced by turbulence of working fluid flow in the turbulence zone. A diameter of an opening 508 under the seat is smaller than a diameter of seating opening of the metal ball, to prevent its displacement to the lower area of the perforator under the action of high pressure of the working fluid.

An inclined lower surface 509 of the perforator is located at an angle to a horizontal plane. If the system is lowered to the ground and sand the inclined surface allows to perform back washing and lifting of the ball to the surface, that would be impossible in this surface was straight. An opening 510 of a suction zone has a funnel shape for embracing a greater space, and it is located on the inclined lower surface of the perforator. 511 is an end lower part of the opening of the suction zone during straight and reverse washing. The body of the perforator has openings 512 for working nozzles and stop screws, that are located perpendicular to the center of the turbulence zone of the perforator and uniformly spaced from each other over the diameter of the perforator. The diameters of the main inlet opening for working fluid supply, of openings for working nozzles and stop screws, of valve opening of the metal ball are identical for uniform distribution of loads in the inner zone of turbulence of the perforator.

The openings for the working nozzles and stop screws have outer seating depressions 513 for a copper gasket for tight hermetic connection. Reinforcing ribs 514 are located at 90 degrees angle perpendicular to the perforator body and for better reliability is produced of one piece with the latter. The reinforcing ribs have a smooth streamline shape without corners and have a smooth shape for a reverse flow of working fluid from the slot. The openings for nozzles are screws have centers 515. Seating depressions 516 are provided in the openings for the nozzles and screws. A conical thread 517 is used for connecting the nozzles and screws in the perforator body.

The openings for the working nozzles and stop screws have axes 518. A metal ball 519 interacts with the seat of the perforator and interrupts a flow of working fluid during direct and reverse washing, and provides transition of the system to a working condition for cutting. The nozzles and stop screws have axes 520 which intersects in the turbulence zone of the perforator. References 521, 523, 526, 528 identify positions of the nozzles and screws in the perforator body. The nozzles and the screws are located in pairs at an angle of 180 degrees. The perforator ha reinforcing ribs 522 located at an angle 90 degrees and made of one piece with it. They have a smooth streamline shape. The casing of the well has a side surface 525 in contact with the side surface of the perforator. This takes place during lowering and lifting operations. The working nozzles with nozzle holders or stop screws do not contact the casing and are located in a protected zone between the reinforcing ribs of the perforator.

The body 527 of the perforator is made of a single metal piece and has a streamline shape. A nozzle holder 529 is screwed into the opening 512 of the perforator body via a conical thread. The nozzles 530 are composed of sintered mixture of tungsten, carbide and diamond powder. They are welded to the holders.

The hydro-slotting perforation system in accordance with the present invention operates in the following manner.

After testing of a high pressure line and lowering of the underground components to a given depth, a hermeticity of tubing sections is tested by introducing the ball which is seated in the seat of the adaptor, reliably closes a space under the adaptor, and is tested under high pressure. Then if the results are positive, the pressure is reduced and the ball is lifted to the surface by a back washing. After the testing ball reaches the surface, a metal valve ball is dropped into a break between the high pressure line and the tubing in free fall. In order to make sure that the valve ball hermetically closed the central opening of the perforator, pressure must be smoothly increased with a supple of water. If the pressure increased sharply, this means that the valve ball is seated in the seat. Then the pressure is raised to a given value and maintained. When it is determined that the pumping aggregates operate normally without jumps, a sand of a certain concentration is supplied. Based on the volume of supplied working fluid and the volume of the inner space it is possible to calculate time of reaching the perforator by a first lot of the sand. This can be seen on a monitor chart as a small pressure jump. A second jump will be observed after cutting of the casing.

The working fluid composed of a mixture of water (pure water or formation water) and abrasive quarts sand of certain concentration and under certain pressure is introduced through the tubing into the system. Because of the obstacle provided by the metal ball sitting in the seat, the working fluid through the nozzles of the perforator is ejected into the inner well space with cutting of the casing and the cement ring, and further into a near-well zone into a productive formation. The working fluid which presses the valve ball inside the perforator starts moving the rod component of the system, including the rod of the hydraulic cylinder with hydraulic pistons, the rod of the spring cylinder with the return springs, and the rod with the perforator with the nozzles downwardly along the borehole of the well, with overcoming of force of the return spring.

The rod of the hydraulic cylinder starts pulling down the valve piston, whose parts are collapsed and leave a single path for flow of oil from the inner space of the hydraulic cylinder between the valve upper piston and the floating lower piston into the space between the upper valve piston and the upper cover of the hydraulic cylinder, through the capillaries of the dosing device which is regulated for providing a flow of predetermined quantity of oil during a strictly predetermined time period. The process of overflowing of oil is slow and smooth, thus providing a significant braking of the rod component of the system so as to move with a uniform and straightly directed speed.

Over this perior of time the working jets from the nozzles cut the casing, the cement ring, and the formation over an optimal depth. An increase of rod movement speed by increasing the working pressure shortens the depth of cutting, while a reduction of the speed by reduction of the working pressure increases the depth of the slot. Due to the straight movement of the perforator with the nozzles along the borehole, the working jet are not perpendicular but deviate upwardly against the perforator movement to create an excavating effect, as the washed out rock from the cut slots is returned by a reverse jet above a point of action of the working fluid jet, depending on the perforator speed of movement.

During the operation the valve piston of the hydraulic cylinder will be approaching the floating piston under the action of rod force, until it reaches the floating piston and presses it against the lower cover of the hydraulic cylinder. The oil flows from the space between the pistons through the dosing device of the valve piston into the space between the valve piston and the upper cover of the hydraulic cylinder. This will correspond to extension of the rod over its full length and the length of the cut slot. The moment of extension of the piston over the whole length can be seen on the monitor based on change of frequency of amplitude vibrations of pressure of the working fluid, which is different from the cutting mode.

The floating piston during the hydro-slotting operation is not necessarily located at the bottom of the hydraulic cylinder on it lower cover. It regulates and equalizes the inner pressure of oil chamber of the hydraulic cylinder between the valve and floating pistons and outer hydrostatic pressure inside the borehole. During extension of the working rod with the perforator over its whole length, the force of the spring which is compressed generates an additional force, which slows the movement of the perforator. The pressure of the working fluid can be then increased to maintain the initial parameters of the cutting speed.

After the working rod extended over its whole length the supply of said is stopped. Based on the volume of the working fluid and the volume of the inner space of the well between the casing and the tubing it is possible to calculate the time necessary for washing out of the last quantity of sand from the tubing and from the casing. After elapsing of time of full washing of said from the well, the pressure is reduced. When the pressure is reduced the return spring moves the rod with the perforator and the pistons of the hydraulic cylinder to the initial position, and the system is ready for a new cutting operation.

When the rod is moving up with the valve piston of the hydraulic cylinder the spring is relaxed, and oil flows through inner cavities of the valve piston between the inner walls of the piston and the outer surface of the rod, and not through the dosing device, which is a faster process, which can last a few seconds as there is not braking in the hydraulic cylinder.

The system is then moved by means of the tubing to the beginning of a next interval of cutting, and the cutting process is carried out again. If no next cutting is desired, a direct washing is performed through the nozzles of the perforator, and then a reverse washing.

The present invention is not limited to the details shown since various modifications and structural changes are possible without departing in any way from the spirit of the invention.

What is desired to be protected by Letters Patent is set forth in particular in the appended claims.

The invention claimed is:

1. An underground hydro-slotting perforation system, comprising an adapter connectable to a tubing; a tail part connected to said adapter; a hydraulic block connected with said tail part; a return block connected with said hydraulic block; and a perforator connected with said return block and providing a hydro-slotting, wherein said adapter is provided with two openings which have different diameters, follow each other in an axial direction, and form therebetween a seat, with which a ball that closes said seat cooperates for testing the tubing, wherein said return block unit includes a cylinder with spring unit consisting of two springs having opposite left and right winding directions, a rod extending inside through said two springs, and side bearings arranged in points of action of said two springs above, below and in the middle of sad cylinder of said return block.

2. An underground hydro-slotting perforation system of claim 1, wherein said return block unit includes hermetic upper and lower lateral bearings and covers, and a plurality of gaskets including an upper gasket located near said upper cover, and the lower gasket located in said lower cover.

3. An underground hydro-slotting perforation system of claim 1, wherein said perforator has a lower surface which includes a first lower surface portion extending at an angle to a horizontal plane and provided with an opening, and an adjoining second lower surface portion which extends in a horizontal direction.

4. An underground hydro-slotting equipment of claim 3, wherein said first lower surface portion merges into said second power surface portion of said perforator.

* * * * *